US006668492B2

(12) United States Patent
Warns

(10) Patent No.: US 6,668,492 B2
(45) Date of Patent: Dec. 30, 2003

(54) GUTTER OVERFLOW CHUTE

(76) Inventor: Nicholas Miller Warns, 5 Catton Grove Rd., Norwich NR3 3NJ (GB)

( * ) Notice: Subject to any disclaimer, the term of this patent is extended or adjusted under 35 U.S.C. 154(b) by 0 days.

(21) Appl. No.: 09/739,244

(22) Filed: Dec. 19, 2000

(65) Prior Publication Data

US 2002/0073630 A1 Jun. 20, 2002

(51) Int. Cl.[7] ..... E04D 13/00
(52) U.S. Cl. ..... 52/12; 52/11; 52/15
(58) Field of Search ..... 52/11, 12, 14, 52/15, 16

(56) References Cited

U.S. PATENT DOCUMENTS 3,889,474 A * 6/1975 Frangmeier ..... 61/14
4,368,601 A * 1/1983 Price ..... 52/16
4,998,386 A 3/1991 Baumgarth
5,799,445 A 9/1998 Kock
6,282,844 B1 * 9/2001 Marable ..... 52/11

FOREIGN PATENT DOCUMENTS

GB 1 574 725 3/1976

* cited by examiner

*Primary Examiner*—Carl D. Friedman
*Assistant Examiner*—Jennifer I. Thissell
(74) *Attorney, Agent, or Firm*—Burns, Doanes, Swecker & Mathis, L.L.P.

(57) ABSTRACT

An overflow chute for guttering includes an elongate member having a substantially U-shaped cross-section and includes a weir or barrier therein intermediate an overflow spout and an inlet adapted to engage a section of guttering. The inlet may include male and female coupling portions to link the chute to a standard section of guttering. The inlet may include a downpipe connector having a through-body aperture for directing rainwater into a downpipe. The aperture may be protected by a leaf guard to prevent an accumulation of debris in the downpipe.

15 Claims, 1 Drawing Sheet

GUTTER OVERFLOW CHUTE

FIELD OF THE INVENTION

The present invention relates to handling rainwater collected from the roofs of buildings and more particularly to guttering fixtures.

BACKGROUND TO THE INVENTION

Standard guttering is fixed to the eaves of a building to collect rainwater falling on and directed by the roof of a building. The guttering is normally provided in sections which are joined together and supported by brackets. At selected intervals or at the ends of a length of guttering, comprising a number of sections, a downpipe is provided to allow the collected rainwater to fall for subsequent collection or disposal. It is known that from time to time guttering and downpipes get blocked by assorted debris ranging from leaves, roof moss and portions of birds nests to litter which has been carried on the wind. Significant damage can be caused to buildings when rainwater, which is normally directed through the downpipe, overflows the guttering and washes down the walls and/or windows of the building. When a gutter backs up and fills with rainwater it will overflow at any low point and brackets or bracket fixings may be affected over time. More particularly, the affect of excessive rainwater flowing down the walls of a building, particularly where it is concentrated at one point, may cause significant or irreparable damage to the building. Furthermore, as an overflowing gutter carries a significant weight of water, any weaknesses in the gutter joints, bracket fixings or soffit will be exploited.

It is well established that gutter maintenance is not regularly conducted on either modern or historic buildings. Normally, maintenance is only conducted when a problem or fault becomes apparent. One difficulty is that it is often difficult to ascertain when a gutter is leaking as it can be difficult to distinguish overflowing rainwater from a gutter from rainwater which impinges the wall of a building. Similarly, overflowing rainwater may travel along the underside of a gutter channel until it reaches the downpipe and the overflowing water simply washes down the outside of the downpipe.

It is an object of the present invention to firstly provide a means for safely handling overflowing water in a blocked gutter.

It is further an object of the present invention to seek to alleviate the degradation of buildings and particularly historic structures from the effects of increasingly acidic rainwater.

Finally, it is an object of the present invention to seek to provide a maintenance indicator to draw to the attention of those responsible the fact that gutter maintenance is required.

SUMMARY OF THE INVENTION

The present invention provides an overflow chute for guttering, the chute comprising an elongate member having a substantially U-shaped cross-section and including a weir or barrier therein intermediate an overflow spout and an inlet adapted to engage a section of guttering.

The weir or barrier is formed so as to prevent water travelling along the chute to the outlet spout in normal operating conditions.

Preferably, the height of the weir is selected so that under normal operating conditions, rain or waste water follows its normal outlet path within the guttering. The weir height is such that should the normal outlet path become blocked or the volume of water is greater than the capacity of the guttering, excess water breaches the weir and is directed outwardly from the building to which the guttering is attached.

Advantageously, the inlet includes a length of guttering so that the overflow chute may be interposed between standard guttering sections.

In one arrangement, the overflow chute has a T-shaped profile in which the spar of the T comprises a length of guttering and the leg of the T comprises the overflow chute. An L section profile is also considered for terminating a guttering run.

In a preferred arrangement, the overflow chute is disposed adjacent a downpipe. Advantageously, the overflow chute inlet includes a junction for at least one section of guttering and the downpipe.

While it should be understood that the overflow chute may be self-supporting, it is preferred that a support bracket is provided, the bracket being fixed adjacent the overflow spout at one end and to any one of the downpipe, wall or soffit at the other end.

It will be appreciated that a guttering system incorporating at least one overflow chute of the type described hereinabove constitutes a means for attenuating deleterious degradation of buildings, particularly historical or architecturally important structures due to rainwater.

In a further aspect of the present invention there is provided a maintenance indicator for guttering comprising a gutter overflow chute of the type described hereinabove.

BRIEF DESCRIPTION OF THE DRAWINGS

The present invention will now be described more particularly with reference to the accompanying drawings which show, by way of example only, one embodiment of gutter overflow chute according to the invention. In the drawings.

DETAILED DESCRIPTION OF THE DRAWINGS

Figure 1:
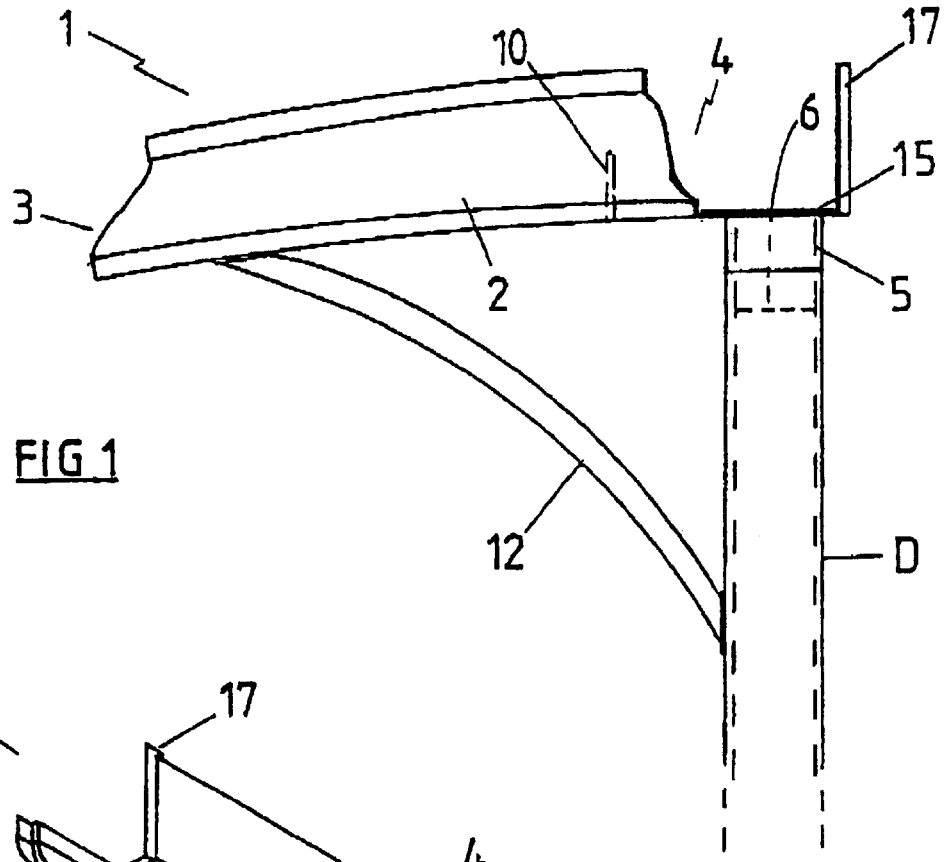
FIG. 1 is a side elevation of an overflow chute including a downpipe.
Figure 2:
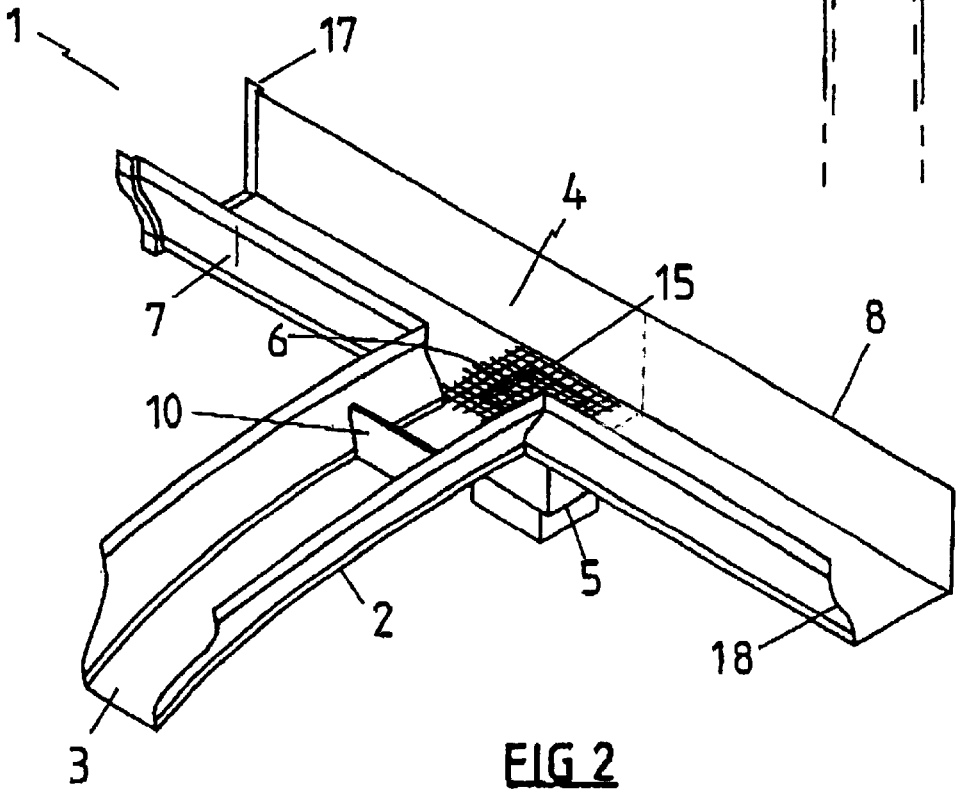
FIG. 2 is a perspective view of the overflow chute.

Referring to the drawings and initially to FIG. 1, the overflow chute 1 comprises a member 2 having a substantially U-shaped cross-section for carrying excessive rainwater from a gutter (not shown) outwardly of a building. At one end of the chute 1 there is provided an overflow spout 3 and at the other end an inlet 4 adapted to engage a section of guttering. In the illustrated embodiment, the inlet 4 includes a downpipe connector 5 for engaging the inner diameter of a downpipe D, The downpipe connector 5 has a through-body aperture 6 for directing rainwater from the gutter. Lengths of guttering 7, 8 to which standard guttering sections may be attached are provided at the inlet 4 on either side of the aperture 6. In the chute 1, interposed the spout 3 and the inlet 4, there is provided a weir or barrier 10. The weir 10 is formed so as to retain water in the gutter in normal conditions but to allow rainwater and debris from the gutter to flow thereover when the gutter becomes blocked or the water handling capacity of the guttering system is exceeded. A curved support 12 is positioned between the downpipe D and the underside of the overflow chute 1 adjacent the outlet spout 3 to provide support. A leaf guard 15 is positioned Over the aperture 6 to prevent excessive debris being sent into a downpipe D, With reference to FIG. 2, the length of guttering 7, 8 are profiled with a male coupling 17 and a female coupling 18, respectively, so that the overflow chute 1 may be coupled to standard sections of guttering. Thus, standard sections of guttering (not shown) having at one end a male coupling and at the other end a female coupling, may be connected to the chute 1 as part of a continuous guttering run.

In use, when the guttering becomes blocked by debris a visual inspection of the overflow spout 3 in times of heavy rain will provide a good indication as to whether gutter maintenance is required either in that the gutter is blocked causing the overflow or the guttering capacity is insufficient to handle the volume of water flow.

By preventing overflowing rainwater flowing down the wall of a building at a particular point, for example where an overloaded gutter has bowed, the deleterious effects of excessive rainwater can be attenuated.

In the preferred arrangement, the chute 1 has a flat-bottomed U-shaped member 2 which projects from the gutter by approximately 0.5 meters. Thus, where the guttering is attached to a soffit, water running from the overflow spout 3 clears the building by at least 0.5 meters and it will only be in the case of very high winds that the overflowing rainwater will be blown back onto the walls of the building to which the guttering is attached. The weir 10 is of any selected height of from approximately 25 mm to 75 mm in gutter having a side wall depth of 125 mm for example. A 100×50 mm rectangular cross-section downpipe D, preferably fixed to the building wall, is attached to the downpipe coupling 5. The overflow chute member 2 and spout 3 are extruded from a plastics material but may also be constructed using metals, resins and the like according to their application and in keeping with the materials used on the building.

The weir 10 illustrated in the above embodiment simply comprises a barrier over which rainwater flows when the level of water in the guttering reaches the top of the weir. The weir may be modified, for example, by having a V-shaped or trapezoidal notch cut therein so that, as before, rainwater is retained in the guttering while the level therein is less than the lower level of the notch. When the notch is breached, a controlled amount of rainwater is released. If the cause of the overflow is not rectified, and the level of rainwater in the gutter continues to rise, the upper level of the weir would also be breached.

The specific embodiment of chute 1 described hereinabove is illustrative of one of a number of feature combinations. Arrangements of chutes having an L-shaped, rather than T-shaped, configuration are considered for the termination of a guttering run. An L-shaped chute is illustrated in phantom in FIG. 2. Further, chutes without a downpipe coupling are considered.

Additionally, the chute 1 is optionally self-supporting but it can be provided with a support 12. In the embodiment illustrated in FIG. 1, the support is attached at one end to the downpipe. A support so sized and shaped as to abut a building wall for attachment thereto is also considered.

It will of course be appreciated that an overflow chute of the type described may be retrofitted to existing guttering by cutting the existing guttering and sealingly attaching a overflow chute thereto. Advantageously, a weir may be formed in the wall of existing guttering and the chute simply attached thereto.

It will of course be understood that the present invention is not limited to the particular details described herein, which are given by way of example only, and that various modifications and alterations are possible within the scope of the invention.

I claim:

1. An overflow chute for guttering, the chute comprising:

an overflow spout;

an inlet adapted to engage a section of guttering a weir or barrier; and an elongate member having a substantially U-shaped cross-sectional channel defining said spout at one end and said inlet at the other end, the weir or barrier being positioned in said U-shaped channel intermediate said overflow spout and said inlet.

2. An overflow chute for guttering according to claim 1, in which the weir or barrier is formed so as to prevent water travelling along the chute to the overflow spout in normal operating conditions.

3. An overflow chute for guttering according to claim 1, in which the height of the weir or barrier is selected so that under normal operating conditions, rain or waste water follows its normal outlet path within the guttering.

4. An overflow chute for guttering according to claim 3, in which the weir or barrier height is such that should the normal outlet path becomes blocked or the volume of water is greater than the capacity of the guttering, excess water breaches the weir or barrier and is directed outwardly from the building to which the guttering is attached.

5. An overflow chute for guttering according to claim 1, in which the inlet includes a length of guttering so that the overflow chute is interposed between standard guttering sections.

6. An overflow chute for guttering according to claim 1, in which the overflow chute has a T-shaped profile, the spar of the T-shape comprising a length of guttering and the leg of the T-shape comprising the overflow spout.

7. An overflow chute for guttering according to claim 1, in which the overflow chute has an L-shaped profile, one portion of the L-shape comprising a length of guttering and the other portion thereof comprising the overflow spout.

8. An overflow chute for guttering according to claim 7, in which the L-shaped chute comprises a terminal portion of a guttering run.

9. An overflow chute for guttering according to claim 1, in which the overflow chute is disposed adjacent a downpipe.

10. An overflow chute for guttering according to claim 1, in which the overflow chute inlet includes a junction for at least one section of guttering and a downpipe.

11. An overflow chute for guttering according to claim 1, in which the overflow chute is self-supporting.

12. An overflow chute for guttering according to claim 1, in which the chute is held by at least one support bracket, the bracket being fixed adjacent the overflow spout at one end and to any one of the downpipe, wall or soffit at the other end.

13. An overflow chute for guttering according to claim 1, in which the weir is notched.

14. A buttering system including an overflow chute comprising:

an overflow spout;

an inlet adapted to engage a section of guttering;

a weir or barrier; and an elongate member having a substantially U-shaped cross-sectional channel defining said spout at one end and said inlet at the other end, the weir or barrier being positioned in said U-shaped channel intermediate said overflow spout and said inlet.

15. A maintenance indicator for guttering comprising:

an overflow chute having an overflow spout;

an inlet adapted to engage a section of glittering;

a weir or barrier; and an elongate member having a substantially U-shaped cross-sectional channel defining said spout at one end and said inlet at the other end, the weir or barrier being positioned in said U-shaped channel intermediate said overflow spout and said inlet, whereby breach of the weir by rainwater resulting in a steady flow of rainwater from the spout is taken as an indicator that flow in the guttering is impeded.

* * * * *